United States Patent [19]

Thrush

[11] Patent Number: 4,557,548

[45] Date of Patent: Dec. 10, 1985

[54] EDGE CONNECTOR FOR CHIP CARRIER

[75] Inventor: Roger L. Thrush, Clemmons, N.C.

[73] Assignee: AMP Incorporated, Harrisburg, Pa.

[21] Appl. No.: 670,857

[22] Filed: Nov. 13, 1984

Related U.S. Application Data

[63] Continuation-in-part of Ser. No. 561,392, Dec. 14, 1983.

[51] Int. Cl.[4] ..... H01R 13/115

[52] U.S. Cl. ..... 339/258 P; 339/276 SF

[58] Field of Search ..... 339/176 MP, 258 R, 258 P, 339/276 SF

[56] References Cited

U.S. PATENT DOCUMENTS

| | | | |
|---|---|---|---|
| 3,601,775 | 8/1971 | Longnecker et al. | 339/176 MP |
| 3,697,926 | 10/1972 | Krafthefer | 339/176 MP |
| 3,818,423 | 6/1974 | McDonough | 339/258 P |
| 3,858,163 | 12/1974 | Goodman et al. | 339/176 MP |

FOREIGN PATENT DOCUMENTS

| | | | |
|---|---|---|---|
| 1431452 | 4/1976 | United Kingdom | 339/176 MP |

*Primary Examiner*—John McQuade

*Attorney, Agent, or Firm*—F. Brice Faller

[57] ABSTRACT

Socket for receiving edge of a chip carrier substrate comprises a dielectric housing having an elongate channel interrupted by partitions having aligned U-slots which limit position of substrate. Cavities separated by the partitions receive U-shaped contacts each having a base with directly opposed arms formed upward therefrom and a flat pin formed downward therefrom and extending into respective apertures in the floor of the channel. Arms present convex rolled inside surfaces to opposed surfaces of substrate for electrical contact therewith. Floor of channel has convex portion in each cavity on which base rocks as pin deflects resiliently in chamfered lead-in to aperture to accommodate any substrate warpage. Profile of U-slot in partition prevents stressing of arms beyond elastic limit. One embodiment of contact comprises a pair of opposed arms formed upward to a bend where each is formed through an obtuse angle toward the other arm of the pair, one arm being stamped from a continuous carrier strip leaving an aperture, each contact being attached to the carrier by a pair of straps.

5 Claims, 8 Drawing Figures

8
2
12
19
50
34
40
32
48
18
20
54
47
33
35
46
44
45
26
27
23
22
28
52
24
4
6
50'
30
19'
34'
48'
18'
47'
38
33'
46'
45'

8
30'
19
30
12
50
34
34'
50'
19'
48'
18
48
18'
38
20
46'
46
35
54
45
44
45'
23
22
28
27
52
24
6
4

EDGE CONNECTOR FOR CHIP CARRIER

This application is a continuation-in-part of U.S. Pat. application Ser. No. 561,392 filed Dec. 14, 1983.

BACKGROUND OF THE INVENTION

The present invention relates to a socket which receives the edge of a chip carrier substrate.

Edge connectors for printed circuit boards are well known. These are generally mounted to a mother board and employ card guides which direct a daughter board into contact with terminals in a dielectric housing. The terminals may lie in two rows and make independent contact with traces on opposite sides of a daughter card, as in U.S. Pat. No. 4,077,694, or may lie in a single row, each terminal having two arms for redundant contact on opposite sides of a board, as in U.S. Pat. No. 3,601,775. In any such connector it is desirable to design the terminals and housings to preclude the possibility of bending the contact portion of a terminal beyond the elastic limit, which could affect the intergrity of contact in future inserted boards.

The advance of semiconductor technology has resulted in development of chip carriers which comprise substrates on which the chips are mounted and electrically connected by fine wire leads. The substrates are plugged into sockets having resilient contact members which make contact with surface traces on the substrate. See, e.g., U.S. Pat. No. 3,753,211, which discloses a socket having terminals for contact with opposed edges. In some applications, as where board space is at a premium, it is desirable to connect the substrate on edge to the board. Standard card edge connectors cannot be simply downsized to meet the requirements of a substrate to circuit board connection, known as the level two connection. This connection is relatively much smaller and requires simple, compact contacts on a much closer spacing. As such, variations in board thickness and board warpage are much more likely to deflect contact means beyond the elastic limit, which would adversely affect contact pressure and thus the integrity of the electrical connection of future substrate insertions.

SUMMARY OF THE INVENTION

The present invention is directed to a connector for mounting on a printed circuit board and intended to receive the edge of a chip-carrying ceramic substrate. The connector comprises a dielectric housing molded to receive a row of stamped and formed U-shaped metal contacts in respective cavities separated by intermediate walls having U-slots which limit insertion depth of the substrate. Each contact is directed to separating the flexure required to accommodate the board from the flexure required to accommodate offsetting due to warpage. A U-shaped contact is formed with substrate contact surfaces on convex rolled inside surfaces of directly opposed upstanding arms and a flat pin formed downward from the base of the contact section. This is mounted through a slot in the base of the housing, which slot is chamfered toward the cavity to permit lateral flexure of the pin normal to the rolled surface thereof. This flexure accommodates lateral deflection which may result from substrate warpage. The pin can be offset from the base or stamped therethrough leaving a slot in the base and one of the arms. In one such embodiment, the other arm is stamped from a continuous carrier strip and formed through an obtuse angle toward the sloted arm leaving an aperture in the carrier strip and two points of attachment thereto. This yields a stable strip of contacts which facilitates handling and assembly.

It is the chief object of the invention to provide a high density, compact substrate edge connector having contacts which cannot bend beyond their elastic limit, thereby preserving the integrity of electrical contact after repeated insertions.

It is a further object to proivde an edge receiving contact fit in a housing cavity in a manner which precludes stubbing of the contact arms by an entering substrate.

DETAILED DESCRIPTION OF THE PREFERRED EMBODIMENT

Figure 1:
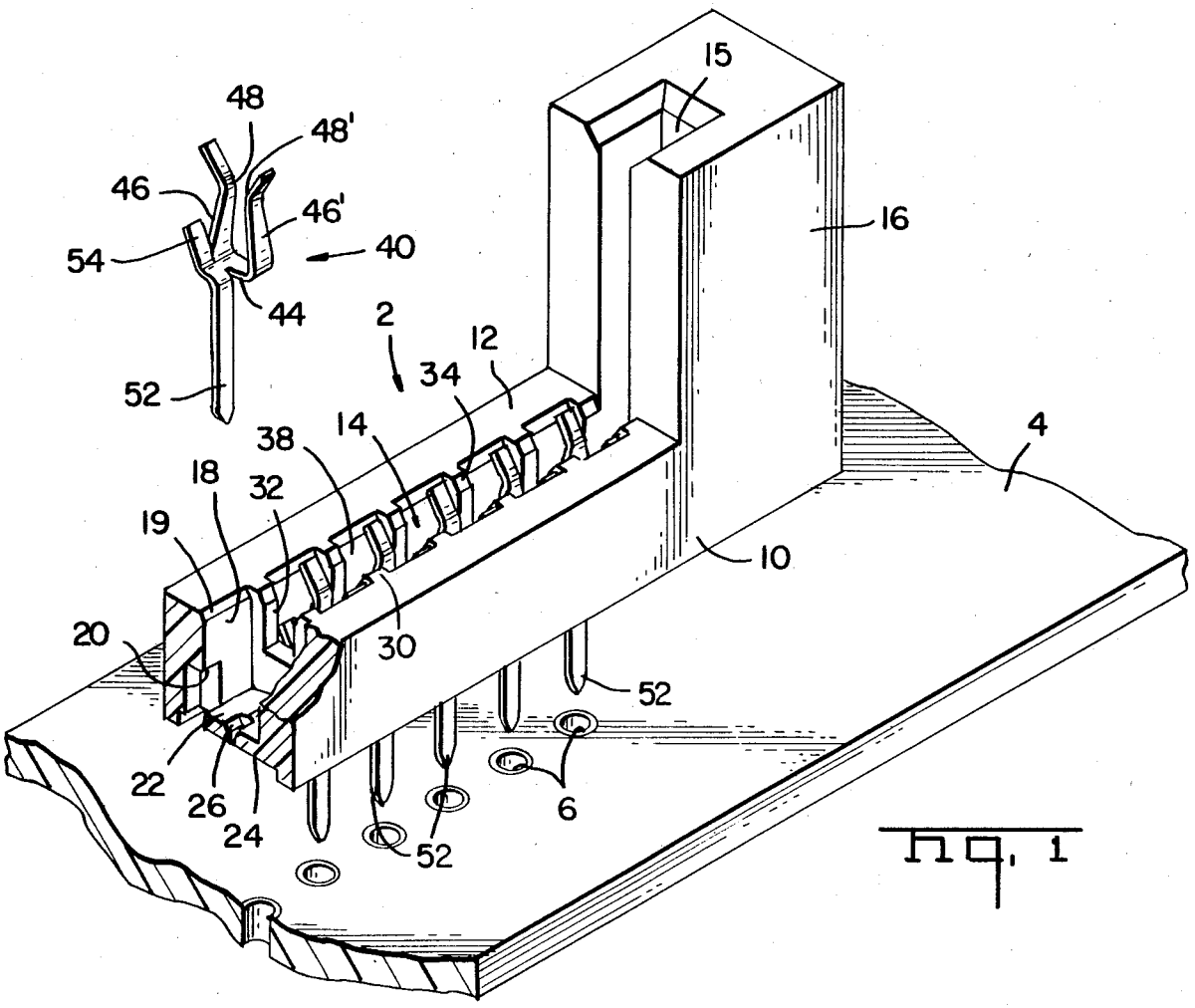
FIG. 1 is a partially exploded connector with the housing cut away.

FIG. 1 is a sectioned perspective of a socket 2 having a single in-line row of pins poised above a circuit board 4 having a row of plated through holes 6. Each socket 2 comprises a dielectric housing 10 having a substrate receiving face 12 having an elongate substrate receiving channel 14 therein. The channel 14 is bounded at the ends by endwalls 15 in upstanding guides 16 which are molded integrally with the housing. The channel 14 is substantially symmetric to a central plane extending the length of the housing 10 and is further bounded by opposed parallel sidewalls 18, 18', which meet face 12 at respective chamfers 19, 19', and a floor 22. Each sidewall 18 is profiled with a shoulder 20 which faces the floor 22. The channel 14 is interrupted by equally spaced partitions 30 having respective mutually aligned U-slots 32 which open on face 12 and are likewise symmetric to the central plane of the housing 10. The channel 14 comprises a plurality of contact receiving cavities 38 separated by the partitions 30; an elongate aperture 26 extends through the portion of floor 22 in each cavity 38 to the recessed face 24 in housing 10 which is opposite substrate receiving face 12.

Referring still to FIG. 1, a generally U-shaped contact 40 is shown exploded from its cavity 38. Each contact 40 comprises a base 44 from which arms 46, 46' are formed upwardly, the arms 46, 46' being formed with respective mutually facing convex contact surfaces 48, 48'. A flat pin 52 is offset to the side of base 44 and is formed downward to be received in aperture 26. The contact 40 is also formed with a lance 54 to be received against shoulder 20.

Note, that like any stamped and formed metal contact, the contact 40 has both sheared and rolled surfaces. The rolled surfaces are present on the strip stock prior to stamping and the sheared surfaces subsequently appear as a result of stamping. All axes about which the terminal 40 is then formed are substantially parallel, and parallel the central plane of the connector. Since the thickness tolerances between rolled surfaces may be more closely controlled then between sheared surfaces, it is possible to closely control the spring characteristics of the terminal. Note that the contact surfaces 48, 48' are rolled surfaces. All deflecting forces which the terminal is designed to encounter are normal to one or more rolled surfaces, there being little or no deflecting force on any sheared surface. This is preferable as sheared surfaces are more susceptible to cracking under stress.

Figure 2:
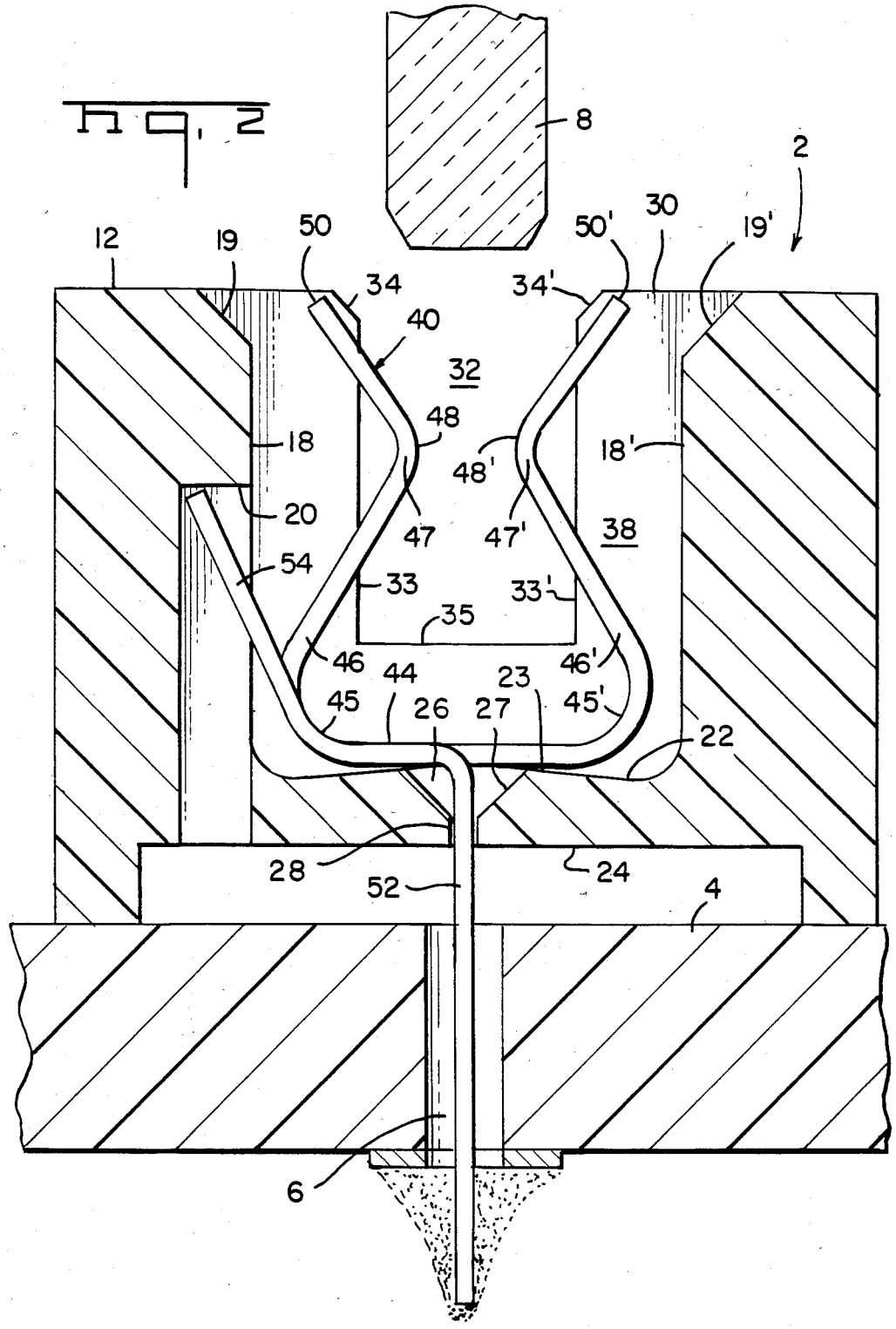
FIG. 2 is a cross section of the connector in place on a circuit board.

FIG. 2 is a cross section of the socket 2 in place on a circuit board 4, with the contact stems in through holes 6 and soldered to traces on the bottom of the board 4. Each aperture 26 has a chamfered lead-in 27 in floor 22 and a retaining section 28 which receives the pin 52 closely between the lead-in 27 and bottom face 24. The base 44 is substantially flat and rests on the convex portion 23 of floor 22, the apex of the convex portion 23 lying along the central plane of housing 10. In this embodiment, the convex portion 23 extends the length of floor 22, the lead-ins 27 of elongate apertures 26 lying along the apex of the convex portion 23. The arms 46, 46' are continuous with base 44 via bends 45, 45' respectively, where the metal is formed through obtuse angles so that arms 46, 46' are bent away from each other to distal ends 50, 50' via bends 47, 47' respectively, the substrate contact surfaces 48, 48' thus being formed on the outside of respective bends 47, 47'. Note that the distal ends 50, 50' are not exposed beyond partition 30, whereby the possibility of stubbing an inserted substrate 8 against one of ends 50, 50' is precluded. The chamfers 34, 34' serve to guide the substrate 8 into U-slot 32, which is bounded by sidewalls 33, 33' of floor 35. The contact 40 is retained in cavity 38 by the cooperation of lance 54 and shoulder 20. Alternative retention means such an an interference fit between pin 52 and retaining section 28 are contemplated.

Figure 3:
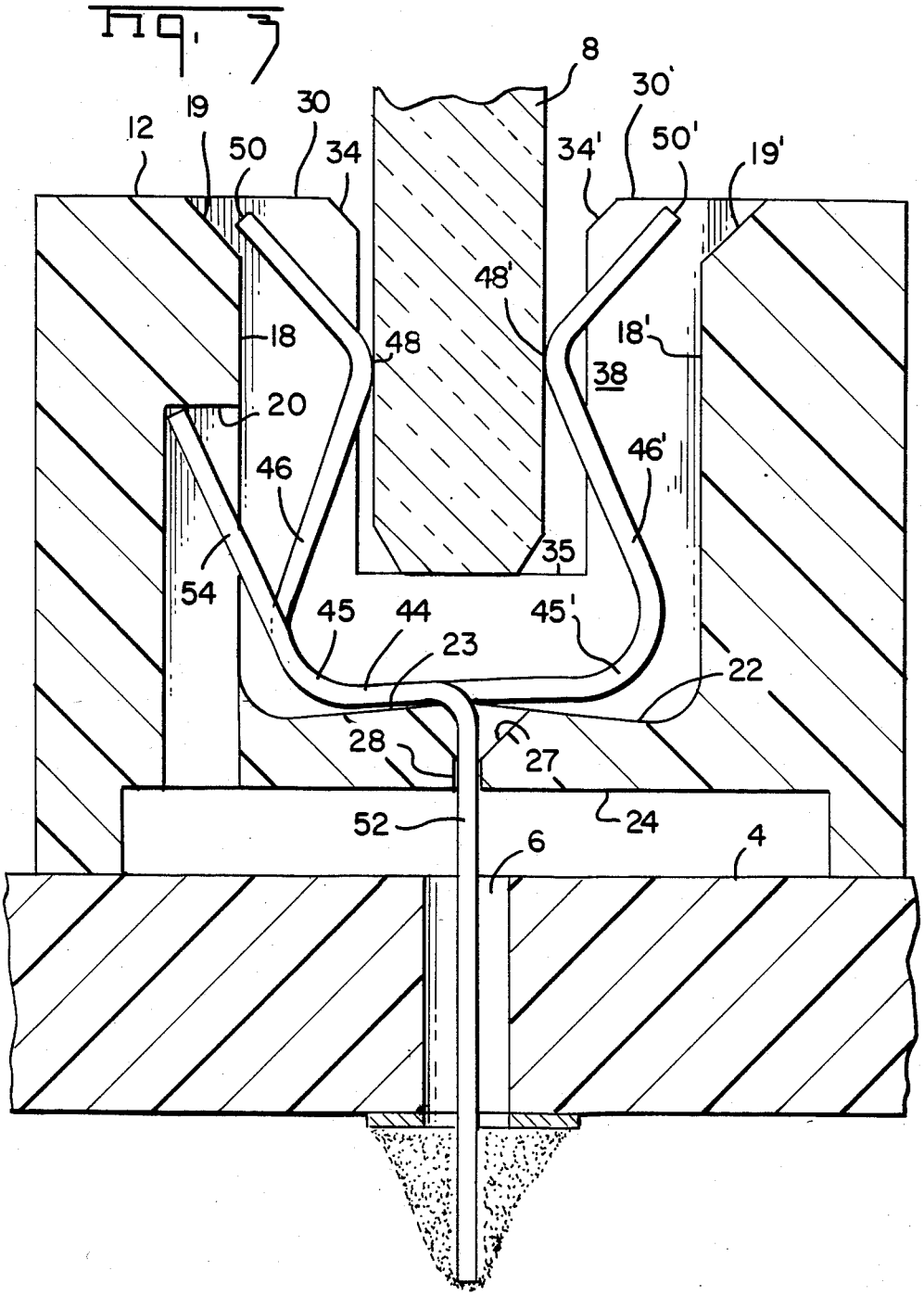
FIG. 3 is a cross section of the connector with the substrate in place.

FIG. 3 depicts a substrate 8 inserted between arms 46, 46' so that the contact surfaces 48, 48' bear against the substrate 8, which is shown offset from the center plane of the housing 10 to illustrate a feature of the invention. Since chip carrier substrates, particularly ceramic substrates, suffer warpage, some lateral deflection of the arms 46, 46' of some contact 40 will occur in addition to the spreading required to accommodate the substrate 8. By design, most of this deflection occurs in the pin 52 where is passes into lead-in 27, and the base 44 rocks on convex surface 23. This lateral deflection of arms 46, 46' and rocking of base 44 is limited by sidewalls 33, 33' of U-slot 32, which limits the lateral position of the substrate 8. Chamfers 19, 19' receive the distal ends 50, 50' at maximum lateral deflection. The contact 40 and housing 10 are designed so that no part of the contact 40 can be deflected beyond the elastic limit, thereby insuring the required contact force on the surface of substrate 8 after repeated insertions. The floor 35 of U-slot 32 prevents the substrate 8 from butting the base 44.

Figure 4:
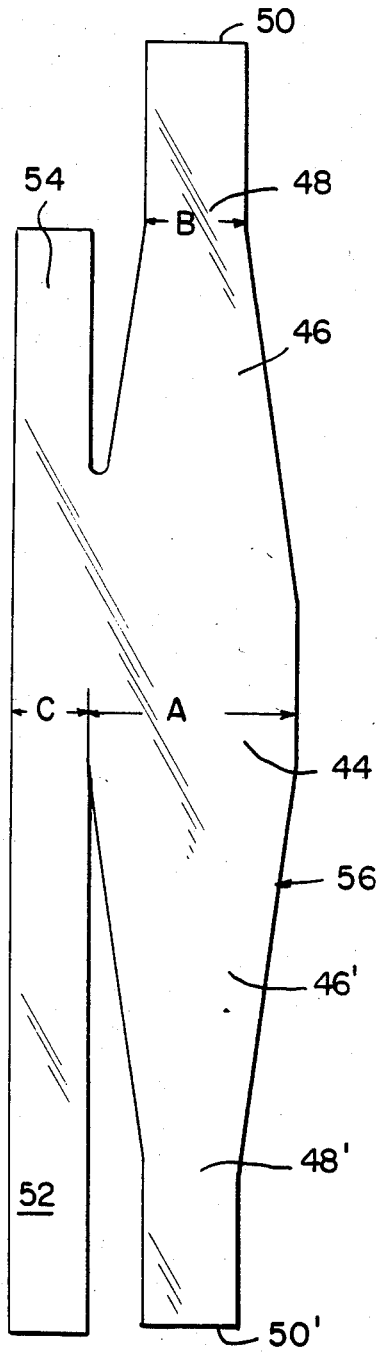
FIG. 4 is a plan view of a contact blank prior to forming.

FIG. 4 illustrates the stamping 56 used for manufacture of a terminal 40, prior to the forming operations. The dimension "A", about 0.055 in., corresponds to the center of base 44; dimension "B", about 0.025 in., corresponds to the contact surface 48, while dimension "C", about 0.020 in., corresponds to the width of pin 52. Thus it can readily be seen that the stem 52 will flex to accommodate board warpage more readily than the arms 46, 46'.

Figure 5:
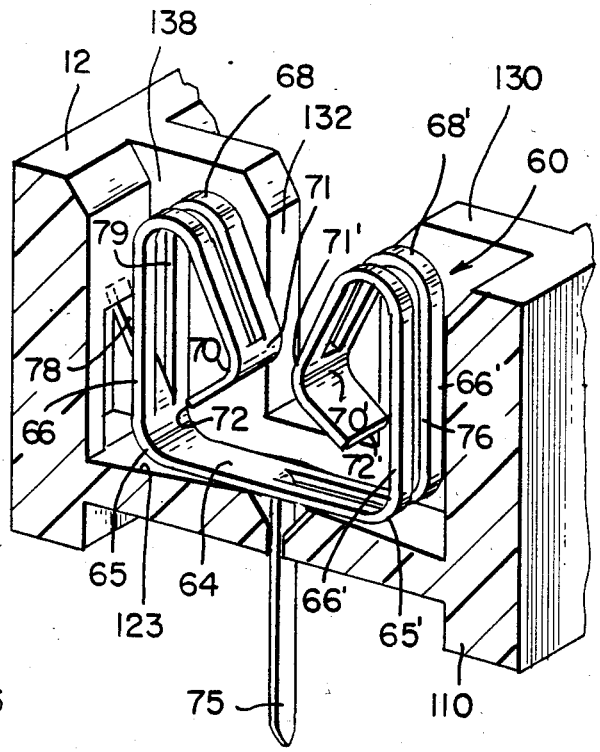
FIG. 5 is a perspective of an alternative embodiment of the contact.

FIG. 5 illustrates an alternative contact 60 according to the present invention. The contact comprises a substantially flat base 64 and contact arms 66, 66' which are formed upward from the base 64 through ninety-degree bends 65, 65' respectively. The arms 66, 66' extend to bends 68, 68' proximate face 12, where the arms 66, 66' are formed through obtuse angles to extend toward the opposite arm of the pair, thence through bends 70, 70' to extend away from each other to distal ends 72, 72' respectively. The retaining lance 78 is struck from arm 66, leaving slot 79, while the pin 75 is struck from base 64 and arm 66', leaving slot 76. The housing 110 is similar to that described for terminal 40 and likewise has cavities 138 with convex portions 123 in the floor on which the contacts rock to accommodate substrate warpage. As before, the U-slots 132 in partitions 130 limit any deflection in the contact 60 which would exceed the elastic limit.

The present invention is directed to a very compact socket, where more complex metal forming operations, long contact arms, and large housings are not desirable. The overall height of the housing 10 described above is 0.160 in. from the board 4 to face 12; the height of the contact 40 from base 44 to distal ends 50, 50' is about 0.120 in. The centerline spacing between contacts 40, 60 in adjacent cavities is 0.075 in. or 0.100 in. and the substrate 8 to be received is 0.040 in. thick. The contacts 40, 60 are designed to work through a $\pm 0.009$ in. range of substrate warpage, the width of U-slot 32 being 0.058 in.

Figure 6:
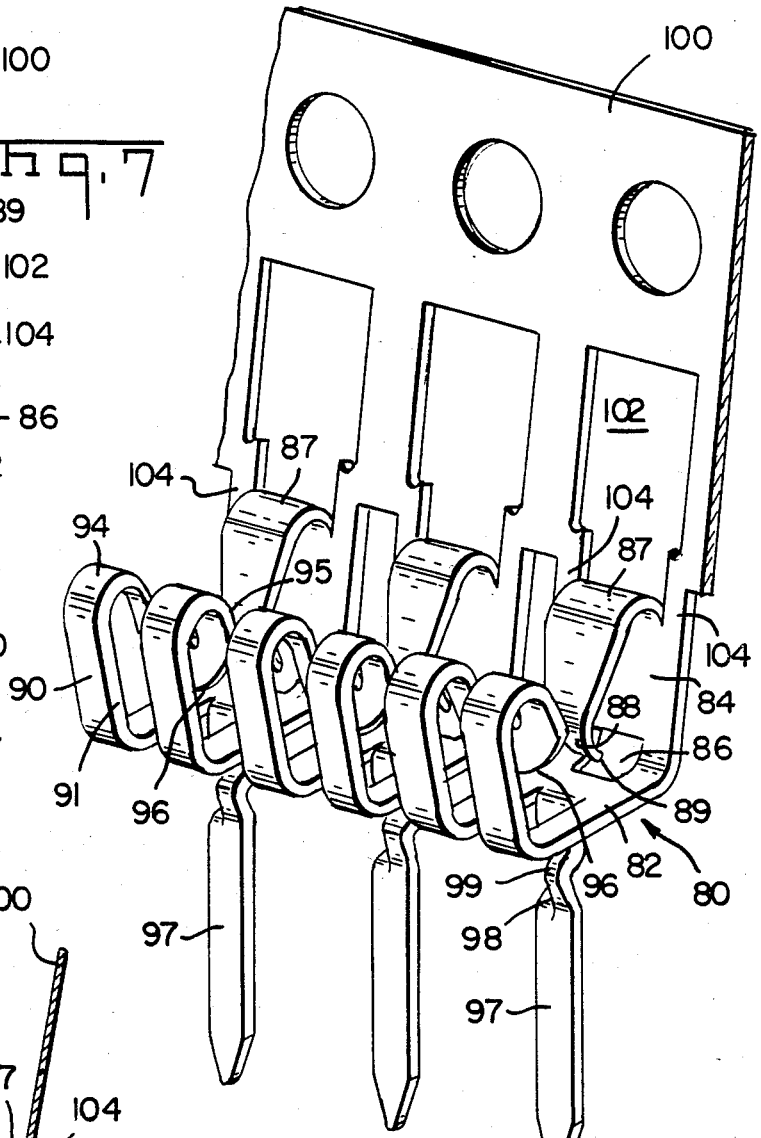
FIG. 6 is a perspective of another alternative embodiment in strip form.

FIG. 6 illustrates another alternative contact 80 in strip form. Each contact 80 comprises a contact section with a first contact arm 84 and a second contact arm 90 formed upward from a base 82. Each arm 84, 90 is formed upward to a respective bend 87, 94 where it is formed through an obtuse angle to extend toward the other arm of the pair. Each arm 84, 90 has a respective contact surface 88, 95 which faces the contact surface on the other arm of the pair. The contact surfaces 88, 95 lie on bends where each arm 84, 90 is formed away from the opposite arm of the pair to a respective distal end 89, 96.

The contacts 80 are attached to a continuous carrier strip 100 laterally thereof in side-by-side relation. The first arm 84 is stamped in part from the carrier strip 100 and the bend 87 is formed therefrom leaving an aperture 102. Each contact 80 is attached to the carrier 100 by a pair of straps 104 extending from opposite sides of the aperture 102 to opposite edges of the first arm 84 proximate to the bend 87. A pin 97 is stamped out of second arm 90 leaving a slot 91 therein. The pin 97 is formed downward from the base 82 for reception in a housing as previously described. Each pin is split along a close-ended shear line 98 proximate to the base 82, and a pair of retaining portions 99 are formed in opposite directions parallel to the plane of the shear line. Note that the portion of first arm 84 which is formed out of aperture 102 is profiled more narrowly than the opposed portion of second arm 90, and further that an aperture 86 is stamped in first arm 84 where the first arm 84 is formed upward from the base 82. These features are provided to offset the effect of slot 91 in the second arm 90, and are profiled to assure that the spring characteristics of both arms 84, 90 are substantially identical.

Figure 7:
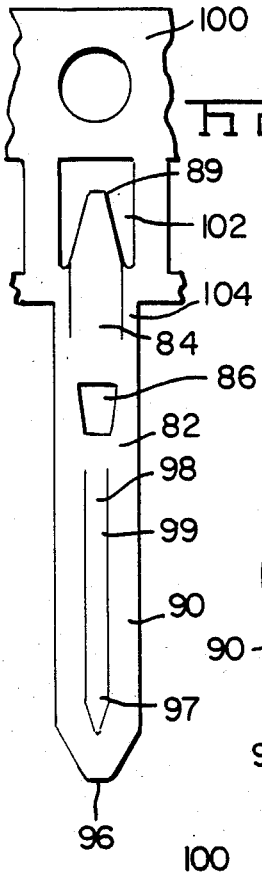
FIG. 7 is a plan view of the stamping for the terminal of FIG. 6.

The stamping from which a contact 80 is formed and the portion of carrier strip 100 to which it attaches are shown in FIG. 7; here the features described in conjunction with FIG. 6 are apparent as they appear prior to forming.

The continuous strip shown in FIG. 6 offers several advantages in handling and manufacturing. Since each contact 80 is attached to the carrier at two points (straps 104), the contacts resist twisting from the array shown. Since the straps 104 are located remotely from the base 82, this permits the contacts 80 to be partially inserted in a housing 110 (FIG. 8) before removing the carrier strip 100, the pins 97 being spaced as the apertures in which they are received. The housing 110 has features substantially as described for housing 10 (FIG. 1).

Figure 8:
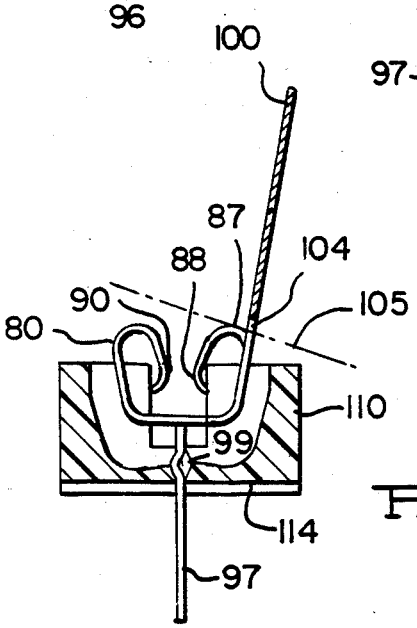
FIG. 8 is an instantaneous side section of the strip being assembled to a housing.

Referring to FIG. 8, once a strip of contacts 80 are partially assembled to housing 110 as shown, the carrier strip 100 is removed by severing at line 105. This may be accomplished by shearing or alternatively the straps 104 may be scored during stamping and broken at this stage. A fixture profiled similarly to a substrate is subsequently inserted in the row of contacts 80 and they are pushed home so that the retaining portions 99 are below the bottom surface 114 of housing 110 to retain the contacts 80 therein.

The foregoing description is exemplary and not intended to limit the scope of the claims which follow.

I claim:

1. A strip of stamped and formed electrical contacts of the type comprising a continuous carrier strip having said contacts attached laterally thereto in side-by-side relation, each contact comprising a contact section having a base and a pair of first and second opposed arms formed upward from the base, the arms being formed with respective mutually facing rolled contact surfaces, each contact further comprising a pin stamped out of the second arm leaving a close-ended slot therein, the pin being formed downward from the base, the strip being characterized in that each arm of each contact extends from the base to a bend remote therefrom where it is formed through an obtuse angle toward the opposite arm of the pair thence to the contact surface, the first arm being stamped from the carrier strip leaving an aperture therein, each contact being attached to the carrier by a pair of straps extending from opposite sides of the aperture to respective opposite edges of the first arm proximate to the bend therein remote from the base.

2. A strip as in claim 1 wherein each pin is split along a close-ended shear line proximate the base, the pin comprising a pair of retaining portions flanking the shear line, the retaining portions being formed in opposite directions parallel to the plane of the shear line, the retaining portions being formed to provide an interference fit in an aperture.

3. A strip as in claim 1 wherein all forming axes of the contact are mutually parallel.

4. A strip as in claim 1 wherein each contact surface lies on a bend where the arm is formed away from the opposite arm of the pair to a distal end.

5. A strip as in claim 1 wherein each contact section has an aperture stamped therein proximate to where the first arm is formed upward from the base, the first arm and said aperture being profiled such that the spring characteristic of the first arm is substantially similar to the spring characteristic of the second arm.

* * * * *